US008094180B2

(12) United States Patent
Onuma et al.

(10) Patent No.: US 8,094,180 B2
(45) Date of Patent: Jan. 10, 2012

(54) CONVEYING APPARATUS AND RECORDING APPARATUS

(75) Inventors: Kentaro Onuma, Yokohama (JP); Hiroyuki Saito, Yokohama (JP); Koichiro Kawaguchi, Yokohama (JP); Motoyuki Taguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 437 days.

(21) Appl. No.: 12/424,258

(22) Filed: Apr. 15, 2009

(65) Prior Publication Data

US 2009/0278905 A1 Nov. 12, 2009

(30) Foreign Application Priority Data

May 8, 2008 (JP) ..... 2008-122343

(51) Int. Cl.
*B41J 2/435* (2006.01)
*B65H 1/18* (2006.01)

(52) U.S. Cl. ..... 347/262; 347/264; 271/153

(58) Field of Classification Search ..... 347/139, 347/262, 264; 271/153, 227, 258.05
See application file for complete search history.

(56) References Cited

U.S. PATENT DOCUMENTS

| | | | | |
|---|---|---|---|---|
| 5,482,390 | A | 1/1996 | Murakami et al. | |
| 5,567,069 | A | 10/1996 | Suzuki et al. | |
| 5,784,082 | A | 7/1998 | Shinmachi et al. | |
| 5,872,581 | A | 2/1999 | Yanagi et al. | |
| 5,975,666 | A | 11/1999 | Kawaguchi | |
| 5,988,809 | A | 11/1999 | Yokoi et al. | |
| 6,027,211 | A | 2/2000 | Unosawa et al. | |
| 6,092,892 | A | 7/2000 | Taniguro et al. | |
| 6,170,817 | B1 * | 1/2001 | Kawaguchi | 271/167 |
| 6,293,670 | B1 | 9/2001 | Taniguro et al. | |
| 6,305,682 | B1 * | 10/2001 | Saito et al. | 271/10.11 |
| 6,869,176 | B2 | 3/2005 | Saito | |
| 7,063,417 | B2 * | 6/2006 | Iwakura et al. | 347/104 |
| 7,073,880 | B2 | 7/2006 | Takahashi et al. | |
| 7,137,698 | B2 | 11/2006 | Miyake et al. | |
| 2007/0059052 | A1 | 3/2007 | Tanaami | |

FOREIGN PATENT DOCUMENTS

| | | | |
|---|---|---|---|
| EP | 1190857 | A2 | 3/2002 |
| EP | 1510352 | A1 | 3/2005 |
| JP | 63-011369 | A | 1/1988 |
| JP | 2003-94740 | | 4/2003 |
| JP | 2003-212364 | | 7/2003 |
| JP | 2005-247584 | | 9/2005 |
| JP | 2006-076118 | A | 3/2006 |
| JP | 2007-70105 | | 3/2007 |
| KR | 10-0555281 | B1 | 3/2006 |

* cited by examiner

*Primary Examiner* — Hai C Pham
(74) *Attorney, Agent, or Firm* — Fitzpatrick, Cella, Harper & Scinto

(57) ABSTRACT

A conveying apparatus includes a lever swinging in contact with a recording medium conveyed along a conveying path in a conveying direction, a sensor detecting the swinging of the lever, a moving unit for moving the lever from a position where the lever is allowed to contact the recording medium in the conveying path to a position where the lever is retracted from the conveying path, a guide unit being movable between a first position and a second position, the guide unit guiding the recording medium conveyed in a direction opposite to the conveying direction to the conveying path when the guide unit is located in the second position and a transmitting unit for transmitting the movement of the guide unit to the moving unit through motion of at least one member to link the movement of the guide unit from the first position to the second position with the movement of the lever to the position where the lever is retracted from the conveying path, the movement of the lever being performed by the moving unit.

7 Claims, 13 Drawing Sheets

CONVEYING APPARATUS AND RECORDING APPARATUS

BACKGROUND OF THE INVENTION

1. Field of the Invention

The present invention relates to a conveying apparatus conveying a recording medium and a recording apparatus recording an image on the recording medium.

2. Description of the Related Art

In recent years, recording apparatuses such as printers have commonly been applied not only to recording of texts on plain paper but also to recording of photographic images on dedicated photo paper. In particular, for ink jet printers, the size of ink droplets has been increasingly reduced, resulting in image quality equal to or higher than that of silver halide photos. Thus, high-precision conveying techniques for conveying recording media are demanded, and high-precision rollers including, for example, a metal shaft coated with a grinding stone are used as conveying rollers. Furthermore, the rotation amount of a DC motor is accurately and quickly controlled by a code wheel and an encoder sensor provided on a shaft of the conveying roller. This allows both high-precision and quick conveyance to be achieved.

Furthermore, to manage a recording position with respect to a recording medium, a paper end detecting unit for detecting the leading and trailing end positions of a conveyed sheet material is provided; the paper end detecting unit is made up of an optical sensor and a lever that shields a light receiving and emitting path of the sensor. When the sheet material comes into contact with the lever, the lever moves pivotally around a rotating shaft of the lever. A part of the lever then opens or shields an optical path for an optical sensor, which thus detects the end of the sheet material. The paper end detecting unit is configured to be able to detect the ends (leading and trailing ends) of sheet materials of all width sizes fed from an upstream side of the conveying roller.

With improved image quality provided by the recent recording apparatuses, there has been an increasing demand to enable recording on various recording media. By way of example, there has been a demand to enable recording on disk-shaped recording media (hereinafter referred to as "disk media") such as CDs (Compact Discs) or DVDs (Digital Versatile Discs) the surface of which can be subjected to ink jet recording. The disk media have an inherent data recording surface located opposite to an ink jet recorded surface. The data recording surface is easily externally damaged. Thus, the disk medium cannot be independently set in the recording apparatus because of possible damage. Consequently, the disk medium essentially needs to be conveyed on a carrier using a dedicated tray. Furthermore, special recording media having the same shape as that of the carrier have recently been developed. For recording, such recording media can be stacked on a guide on which dedicated tray are stacked.

The rigidities of the disk media and the dedicated trays are higher than that of sheet materials such as paper. Thus, feeding the disk media from an auto sheet feeder (hereinafter referred to as an "ASF") is difficult; the auto sheet feeder feeds sheet materials at any angle while bending the sheet materials, instead of feeding the sheet materials horizontally relative to the conveying roller. Thus, the recording apparatus for disk media includes a dedicated supply port. In general, the supply port dedicated to the disk media is often provided on the front side of the recording apparatus in order to simplify user operation. Furthermore, to allow a reduction in the size of the recording apparatus, the guide along which the tray dedicated to disk media is guided to the supply port generally has two positions, a supply position and a housing position instead of being always located in the supply position.

In such a recording apparatus, a PE sensor lever (Paper End detecting sensor lever) is configured as follows in order to reduce detection errors caused by a sheet material caught on the lever or flapping of the lever. That is, the tip of the lever is shaped and located so as to form an acute angle to an abutting portion of the sheet material in a sheet material conveying direction. The angle of the PE sensor lever is generally set with a sheet material feeding direction from ASF taken into account. When the PE sensor lever is located in a disk medium conveying path, if the tray is inserted through the disk media-only supply port, formed in the front of the recording apparatus as mentioned above, the tray may interfere with the PE sensor lever. Thus, the PE sensor lever may be damaged.

Thus, in the conventional art, as illustrated in FIGS. 8 and 9, a PE sensor lever (Paper End detecting sensor lever) 321 is positioned away from the conveying path for the disk media tray to prevent the tray from interfering with the PE sensor lever 321.

In FIGS. 8 and 9, a first sheet material A is a recording medium with the minimum width size that can be conveyed from the ASF (not illustrated in the drawings) of the recording apparatus. A second sheet material B is a recording medium with the maximum width size that can be conveyed from the ASF of the recording apparatus. A feeding roller 28 feeds sheet materials stacked on the ASF to a recording portion of the recording apparatus. Roller rubber 281 is installed on a part of the feeding roller 28. APE sensor 32 is attached to a chassis (not illustrated in the drawings). The PE sensor lever 321 shields and opens a light receiving portion and a light emitting portion of the sensor, which can then detect an end of the sheet. A conveying roller 36 forms a nip together with a pinch roller 37 biased from upward, to convey the recording medium. A discharging roller 40 is provided, in a recording medium conveying direction, on the downstream side of a carriage 5 with a recording head mounted thereon. The discharging roller 40 forms the nip together with an opposing spur (not illustrated in the drawings) to convey the recording medium, the trailing end of which has passed through the nip formed by the conveying roller 36 and the pinch roller 37, to discharge the recording medium to the exterior of the recording apparatus. A tray guide 1001 feeds a tray 1003 dedicated to disk media from the front of the recording apparatus to the interior of the main body. A tray 1003 is shaped to engage with a disk medium 1002, and includes a reflector 1004 located on the top surface thereof to detect the position of the tray 1003. As illustrated in FIGS. 8 and 9, a detecting portion (lever portion) of the PE sensor lever 321 and an end of the tray 1003 are arranged so as to set any distance dL between the detecting portion and the end, with the dimensional tolerances of the components and the possibility that the tray 1003 is slightly tilted during conveyance, taken into account.

As another conventional example, a construction has been proposed in which a PE sensor lever is retracted from a recording medium conveying path using a motor or solenoid that is dedicated to the retraction or also used for another driving purpose. FIG. 10 is a perspective view showing the construction of the conventional example. As illustrated in FIG. 10, a pinch roller 37 is located opposite a conveying roller (not illustrated in the drawings) to sandwichingly hold and convey a sheet. A pinch roller holder 30 holds the pinch roller. A PE sensor lever is illustrated at reference numeral 321. A lifting cam 1011 retracts the pinch roller holder and the PE sensor lever from the conveying path by a predetermined amount. A lifting gear 1012 is combined coaxially with the cam 1011. An intermediate roller and a cassette conveying motor are illustrated at reference numerals 86 and 85, respectively. Moreover, a plurality of driving gears arrays and planet gear arrays are illustrated at reference numerals 851 and 852, respectively. The intermediate roller 86 conveys, to a recording portion, the recording medium fed from a cassette (not illustrated in the drawings) located on the bottom surface of the recording apparatus.

FIGS. 11A to 11C are schematic sectional views illustrating a retracting operation in the conventional construction illustrated in FIG. 10.

FIG. 11A illustrates a normal recording operation standby state. In the state illustrated in FIG. 11A, the cassette feeding motor 85 is rotated. Then, driving is transmitted to the lifting gear 1012 via the planet gear arrays 852. The cassette conveying motor 85 is normally driven to feed the recording medium from the cassette. The rotating direction of the cassette conveying motor 85 is selected in response to a disk medium conveyance command, or the cassette conveying motor 85 is driven in the direction of a retracting operation by a unit such as a clutch. The conveyance instruction is given when for example, the tray guide 1001 is detected to be set in a disk insertion position or in response to an instruction from a printer driver.

When the lifting gear 1012 rotates, the lifting cam 1011, which is coaxial with the lifting gear 1012, is rotated to pivotally move the pinch roller holder 30 and the PE sensor lever 321. Thus, as illustrated in FIG. 11B, the PE sensor lever 321 is retracted from the conveying path for the tray 1003. Here, an operation is performed which sets the tray 1003 on the tray guide 1001 to insert the tray 1003 into the recording apparatus or draw the tray 1003 into the recording apparatus via the discharging roller 40. In this case, the PE sensor lever 321 has been retracted from the conveying path for the tray 1003 as illustrated in FIG. 11C. Thus, the tray 1003 can be fed into the recording apparatus main body while preventing the tray 1003 from interfering with the PE sensor lever 321. Such a conventional configuration is disclosed in Japanese Patent Application Laid-Open No. 2007-70105.

As another conventional example, a construction has been proposed in which a PE sensor lever is retracted from a recording medium conveying path in conjunction with adjustment of the distance (gap) between a recording medium and a recording head. A carriage with the recording head mounted thereon is supported on a guide shaft so as to be able to scan the recording medium in a direction orthogonal to a recording medium conveying direction. The proposed construction is configured so as to be able to retract the PE sensor lever from the recording medium conveying path in conjunction with operation of a lever that is a gap adjusting unit for operating the guide shaft upward and downward. Such a configuration is disclosed in Japanese Patent Application Laid-Open No. 2003-94740.

However, in the construction in which the PE sensor lever is located outside the recording medium conveying path as in the conventional example illustrated in FIG. 8 or 9, the width size of the recording apparatus is disadvantageously larger than the conventional one depending on the location of the PE sensor lever.

As illustrated in FIG. 12A, the size of the recording apparatus is determined by the width of the sheet material B with the corresponding maximum width size, the acceleration and deceleration distance S101 of a recording head 7, which performs recording on the sheet material B, and the arrangement of nozzles in the recording head 7. A recording operation is normally performed in a constant speed area S102 in which the recording head 7 carries out scanning at a constant speed. Thus, the total distance (S101+S102+S101) corresponds to the minimum distance required to move the recording head 7.

If the disk medium 1002 is conveyed within the area of the maximum width of the sheet material B such as a cut sheet as illustrated in FIG. 12A, the size of the recording apparatus is determined by the sheet material B with the maximum width size. However, if the disk medium 1002 is conveyed beyond the area corresponding to the maximum width of the sheet material B as illustrated in FIG. 12B, the constant speed area of the recording head 7 is S103. Thus, the constant speed area of the recording head 7 increases by dx=(S103−S102), thereby increasing the size of the recording apparatus by dx. Thus, in the construction in which the PE sensor lever is located outside the recording medium conveying path, the size of the recording apparatus may disadvantageously increase depending on the conveying path for the disk medium 1002.

Furthermore, in the construction in which the PE sensor lever 321 is located in the recording medium conveying path as illustrated in FIG. 13, an arrangement may be adopted which retracts the PE sensor lever 321 from the recording medium conveying path as in the case of Japanese Patent Application Laid-Open No. 2007-70105. However, in this case, apparatus costs may disadvantageously increase. This is because a dedicated motor needs to be provided to drive the PE sensor lever 321. Additionally, if an existing motor is also used to drive the PE sensor lever 321, a complicated sequence is required, thus making appropriate operation of the PE sensor lever 321 difficult. For example, if a retracting operation is started using opening or closing of a tray guide as a trigger, the PE sensor lever 321 disadvantageously cannot be quickly retracted from the recording medium conveying path. Moreover, in the construction in which the PE sensor lever 321 is retracted by driving the motor, the PE sensor lever 321 cannot be retracted while a power supply is off. Thus, when the tray 1003 is inserted into the apparatus in this state, the PE sensor lever 321 may disadvantageously be damaged.

Furthermore, in the construction in which the PE sensor lever is retracted in conjunction with the gap adjusting unit as in the case of Japanese Patent Application Laid-Open No. 2003-94740, the gap adjustment and the retraction of the PE sensor lever are simultaneously performed. This disadvantageously complicates the construction. Additionally, a detecting unit is disadvantageously required which detects whether or not a user has adjusted the gap.

SUMMARY OF THE INVENTION

Thus, an object of the present invention is to provide a recording apparatus simply configured so as to be able to retract a sensor lever (a detecting unit) from a recording medium conveying path without the need for a driving unit such as a motor.

To accomplish the object, a recording apparatus according to the present invention includes a conveying unit making up a conveying path along which a recording medium on which an image is to be formed is conveyed, a detecting unit for detecting an end of the recording medium conveyed along the conveying path, and a guide unit located on a downstream side of the conveying path in a conveying direction, the guide unit being able to move between a first position and a second position, the guide unit guiding the recording medium conveyed from the downstream side in the conveying direction into the conveying path. The recording apparatus further includes a moving unit for moving the detecting unit to a position where the detecting unit enters the conveying path and a position where the detecting unit is retracted from the conveying path, in conjunction with the movement of the guide unit, and the moving unit is configured to place the detecting unit at the position where the detecting unit enters the conveying path when the guide unit is located in the first position and to place the detecting unit at the position where the detecting unit is retracted from the conveying path when the guide unit is located in the second position.

The present invention can provide the recording apparatus simply configured so as to be able to retract the detecting unit from the recording medium conveying path without the need for a driving unit such as a motor.

Further features of the present invention will become apparent from the following description of exemplary embodiments with reference to the attached drawings.

DESCRIPTION OF THE EMBODIMENTS

An exemplary embodiment of the present invention will be described below with reference to the drawings.

Figure 1:
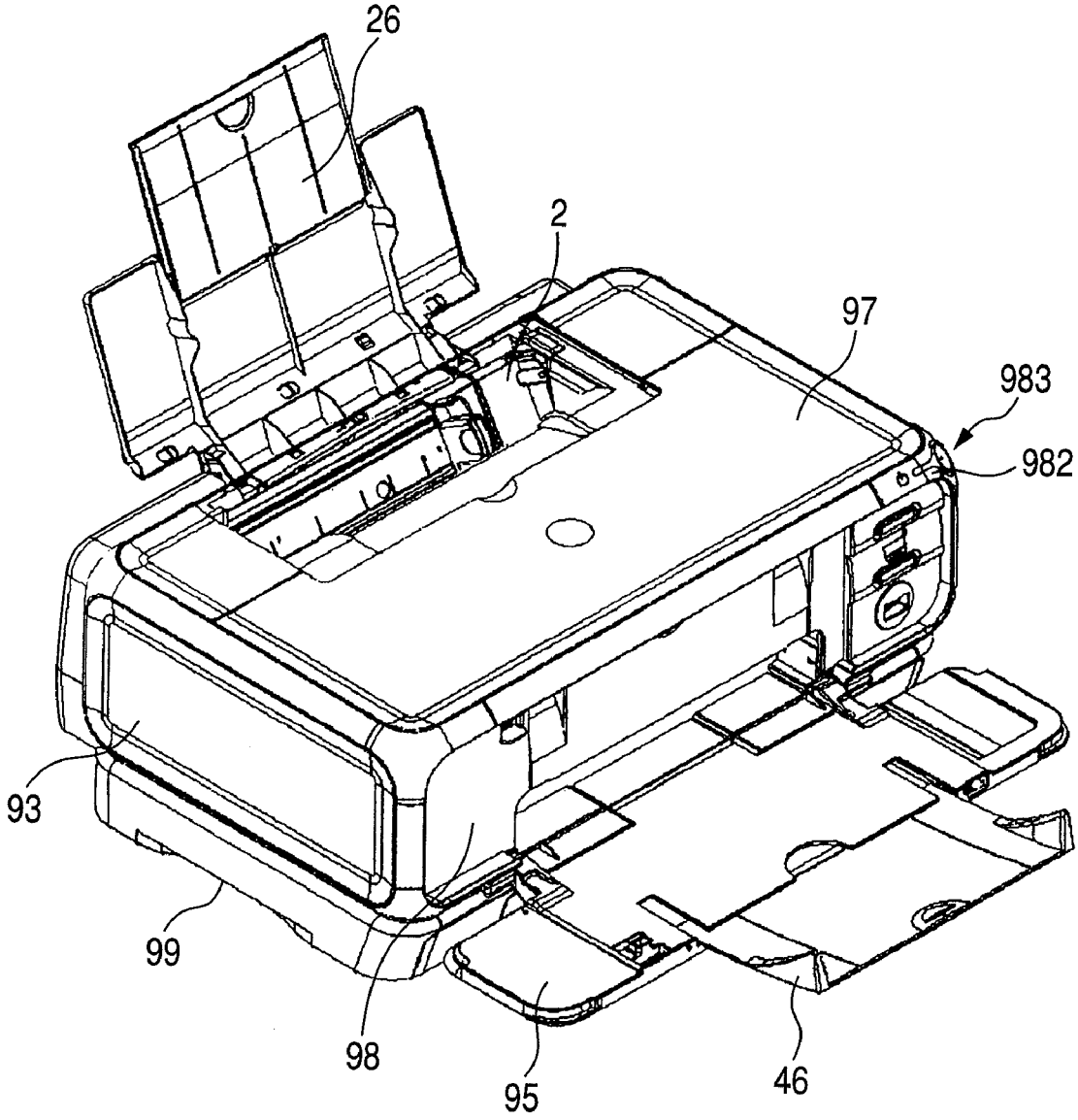
FIG. 1 is a perspective view of a recording apparatus according to an exemplary embodiment of the present invention.
Figure 2:
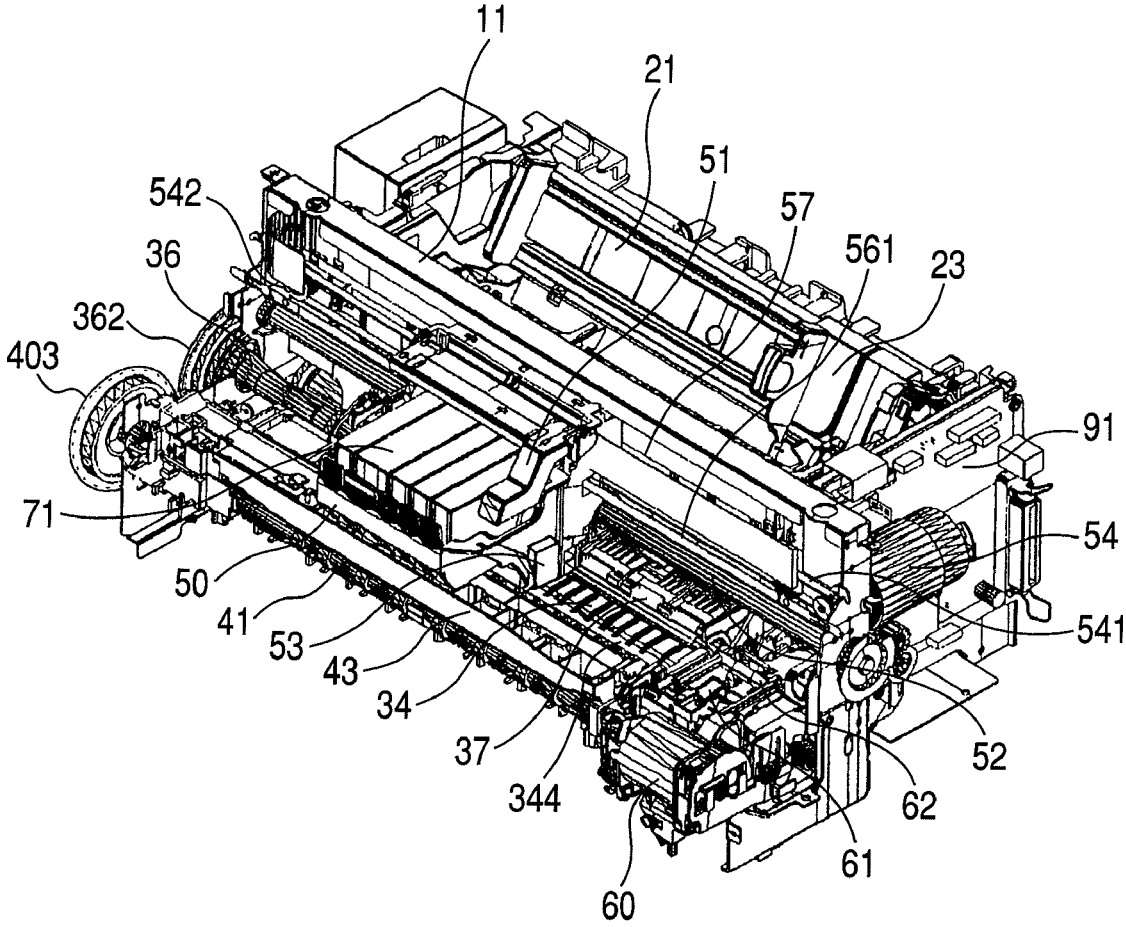
FIG. 2 is a perspective view of a mechanical portion of the recording apparatus according to the exemplary embodiment of the present invention.
Figure 3:
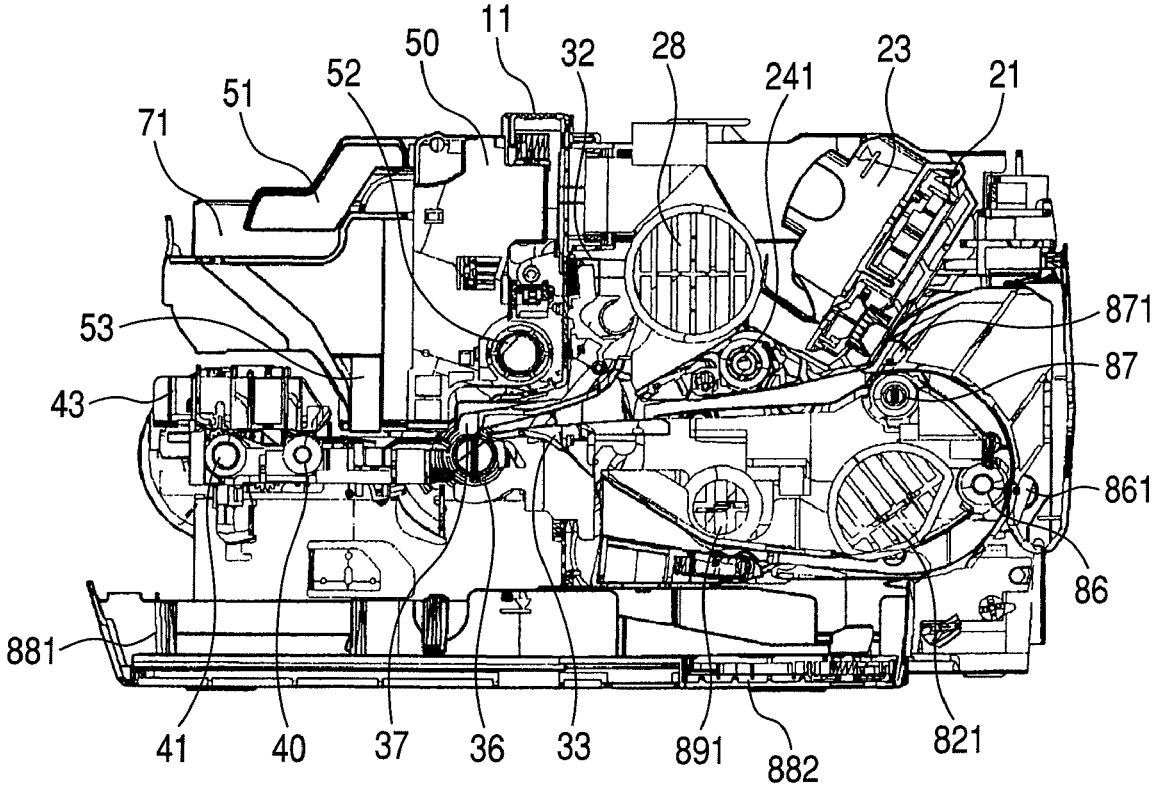
FIG. 3 is a sectional view of the recording apparatus according to the exemplary embodiment of the present invention.

The exemplary embodiment of the present invention will be described with reference to FIGS. 1 to 3. FIG. 1 is a perspective view of a recording apparatus according to the exemplary embodiment of the present invention. FIG. 2 is a perspective view of a mechanical portion of the recording apparatus according to the exemplary embodiment of the present invention. FIG. 3 is a sectional view of the recording apparatus according to the exemplary embodiment of the present invention.

The recording apparatus according to the present embodiment includes a feeding portion, a conveying portion, a carriage portion, a sheet discharging portion, a U turn and automatic double-side conveying portion, a cleaning portion, and an exterior and electric portion. These portions will be sequentially and separately described below.

(A) Feeding Portion

The feeding portion 2 includes a pressure plate 21 on which sheet materials P are stacked, a feeding roller 28 that feeds the sheet materials P, a separating roller 241 that separates a sheet material P from the remaining sheet materials P, and a return lever that returns the sheet materials P to a stack portion; the pressure plate 21, the feeding roller 28, the separating roller 241, and the return lever are attached to a base.

A feeding tray 26 that holds the stacked sheet materials P is attached to the base or an exterior. The feeding tray 26 is of a multistage type and is withdrawn for use.

The feeding roller 28 is shaped like a bar with a circular arc cross section. A piece of feeding roller rubber is provided close to a sheet reference to allow the sheet materials P to be fed. A driving force applied to the feeding roller 28 is transmitted, via drive transmitting gears and planet gears, by a motor (hereinafter referred to as an "AP motor") shared by a cleaning portion provided in the feeding portion 2.

A movable side guide 23 is movably provided on the pressure plate 21 to regulate the position where the sheet materials P are stacked. The pressure plate 21 is rotatable around a rotating shaft combined with the base. The pressure plate 21 is biased toward the feeding roller 28 by a pressure plate spring (not illustrated in the drawings). A separating sheet is provided in an area of the pressure plate 21 located opposite the feeding roller 28; the separating sheet is made up of a material with a large friction coefficient to prevent double feeding of the sheet materials P. The pressure plate 21 is configured to be able to abut against and separate from the feeding roller 28 via a pressure plate cam.

The base further includes a separating roller holder to which the separating roller 241, separating a sheet material P from the remaining sheet materials P, is attached. The separating roller holder is rotatable around a rotating shaft provided on the base. The separating roller holder is biased toward the feeding roller 28 by a separating roller spring. A clutch spring is attached to the separating roller 241. Thus, at least a predetermined amount of load causes rotation of the part of the separating roller holder to which the separating roller 241 is attached. The separating roller 241 is configured to be able to abut against and separate from the feeding roller 28 via a separating roller release shaft and a control cam. The positions of the pressure plate 21, the return lever, and the separating roller 241 are detected by an ASF sensor.

Furthermore, the return lever, which returns the sheet materials P to the stack position, is rotatably attached to the base. The return lever is biased in a releasing direction by a return lever spring. To return the sheet materials P, the return lever is rotated by a control cam.

In a normal standby state, the pressure plate 28 is released by the pressure plate cam. The separating roller 241 is released by the control cam. The return lever returns the sheet materials P and lies at a stack position such that the return lever closes a stack port so as to prevent the sheet materials P from moving toward the interior during stacking. In this state, to start feeding, the motor is driven. First, the separating roller 241 comes into abutting contact with the feeding roller 28.

Then, the return lever is released to bring the pressure plate 21 into abutting contact with the feeding roller 28. In this state, feeding of the sheet materials P is started. The sheet materials P are restricted by a front-stage separating portion provided on the base. Only a predetermined number of sheet materials P are fed to a nip portion formed of the feeding roller 28 and the separating roller 241. Only the highest sheet material P is separated from the other sheet materials and conveyed, by the nip portion.

When the sheet material P reaches a conveying roller 36 and a pinch roller 37, described below, the pressure plate 21 is released by the pressure plate cam. Furthermore, the separating roller 28 is released by the control cam. The return lever is returned to the stack position by the control cam. At this time, the sheet material P having reached the nip portion, formed of the feeding roller 28 and the separating roller 241, can be returned to the stack position.

(B) Conveying Portion

The conveying portion is attached to a chassis 11 made up of crimped sheet metal. The conveying portion includes a conveying roller 36 that conveys the sheet material P in a conveying path, and a PE sensor 32. The conveying roller 36 includes a metal shaft the surface of which is coated with particles of ceramics. The conveying roller 36 is attached to the chassis 11 with metal portions at the opposite ends of a shaft of the conveying roller 36 received by bearings. A conveying roller tension spring is provided between the bearing and the conveying roller 36 to impose a load during rotation to allow stable conveyance.

The conveying portion includes a plurality of pinch rollers 37 that abut against the conveying roller 36 so as to follow the conveying roller 36. The pinch rollers 37 are held by the pinch roller holder and biased toward the conveying roller 36 by a pinch roller spring. Thus, a force with which the sheet material P is conveyed is generated. In this case, a rotating shaft of the pinch roller holder is attached to a bearing of the chassis 11 and rotates around the bearing. Moreover, a paper guide flapper 33 that guides the sheet material P and a platen 34 are disposed at an inlet of the conveying portion to which the sheet material P is conveyed. Furthermore, the pinch roller holder 30 includes a PE sensor lever (Paper End detecting sensor lever) 321 that communicates detection of the leading or trailing end of the sheet P to the PE sensor (Paper End detecting sensor) 32. The PE sensor lever 321 has a swinging center above the conveying path. The platen 34 is attached to and positioned on the chassis 11. The paper guide flapper 33 is fitted into the conveying roller 36 and can swing around a sliding bearing portion. The paper guide flapper 33 is positioned by abutting against the chassis 11.

Figure 4A:
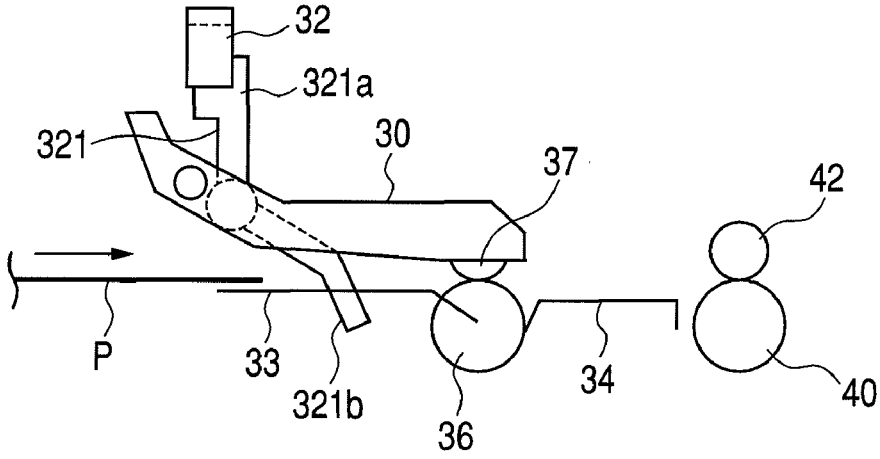
FIGS. 4A, 4B and 4C are diagrams illustrating how a PE sensor lever detects an end of a sheet material.
Figure 4B:
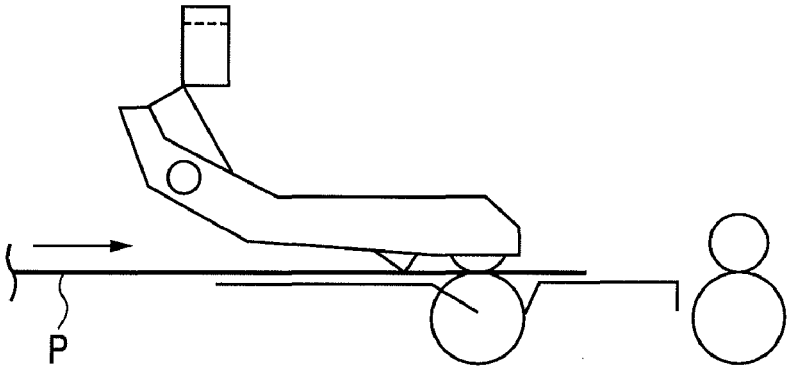
Figure 4C:
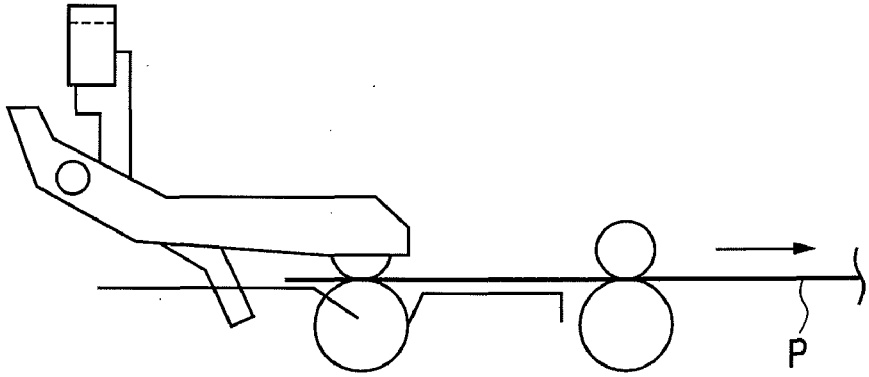

In the above-described construction, the sheet material P fed to the conveying portion is guided to the pinch roller holder and the paper guide flapper 33. The sheet material P is then fed to the roller pair of the conveying roller 36 and the pinch roller 37 (FIG. 4A). The PE sensor lever 321 includes a shielding portion 321*a* that prevents light from a light emitting portion of the PE sensor 32 from reaching a light receiving portion, an abutting portion 321*b* that can contact the recording medium conveyed along the conveying path. The abutting portion 321*b* is located in the conveying path so as to incline downward to the downstream side in the conveying direction. When the leading end of the sheet material P conveyed in the conveying path comes into abutting contact with the abutting portion 321*b*, the PE sensor lever 321 moves pivotally around a support shaft to move the abutting portion 321*b* to a position retracted from the conveying path. The shielding portion 321*a* then opens a light receiving portion and light emitting portion of the PE sensor 32. As described above, the PE sensor 32 and the PE sensor lever 321 detect the leading end of the sheet material P conveyed to the conveying path, to determine a recording position on the sheet material P (see FIG. 4B). Moreover, the conveying motor rotates the roller pair 36, 37 to convey the sheet material P on the platen 34. When the trailing end of the sheet material P passes through the abutting portion 321*b*, the PE sensor lever 321 moves pivotally around the support shaft to advance the abutting portion 321*b* into the conveying path. The shielding portion 321*a* then shields the light receiving portion and light emitting portion of the PE sensor 32. As described above, the trailing end of the sheet material P is detected by the PE sensor 32 and the PE sensor lever 321 (see FIG. 4C). A rib forming a conveyance reference surface is formed on the platen 34. The rib allows the gap between the platen and a recording head to be managed and controls corrugation of the sheet material P together with the sheet discharging portion, described below, so as to prevent the level of the corrugation from being increased.

The rotating force of the conveying motor, made up of a DC motor, is transmitted to the conveying roller 36 by a timing belt via a pulley provided on the shaft of the conveying roller 36. A code wheel 362 with markings formed thereon at a pitch of 150 to 360 lpi (lines per inch) is provided on the shaft of the conveying roller 36 to detect the conveyance amount of the conveying roller 36. An encoder sensor that reads the markings is attached to the chassis 11 at a position adjacent to the code wheel 362.

The recording head, which forms images based on image information, is located on the downstream side of the conveying roller 36 in the sheet material P conveying direction. The recording head is an ink jet recording head with separate, replaceable color ink tanks mounted thereon. The recording head enables ink to be heated via heaters. The heat causes film boiling in the ink, thereby growing or contracting bubbles. Thus, a pressure change occurs to allow the ink to be ejected through a nozzle in the recording head. As a result, an image is formed on the sheet material P. At this time, the sheet material P is supported by the platen 34 to keep the distance from the nozzle in the recording head to the recording surface of the sheet material P at a predetermined value.

Moreover, a platen absorber 344 is provided which absorbs the ink seeping out from the end of the sheet material P in overall recording (borderless recording). The platen absorber 344 is provided on the platen 34 opposite an ink ejection port in the head 71. All of the ink seeping out from the four side ends of the sheet material P is absorbed by the platen absorber 344.

(C) Carriage Portion

The carriage portion includes a carriage 50 to which the recording head 71 is attached. The carriage 50 is supported by a guide shaft 52 allowing reciprocating scans to be performed in a direction orthogonal to the sheet material P conveying direction, and a guide rail that holds the trailing end of the carriage 50 to maintain the gap between the recording head and the sheet material P. The guide shaft 52 is attached to the chassis 11. The guide rail is formed integrally with the chassis 11.

The carriage 50 is driven, via a timing belt 541, by a carriage motor 54 attached to the chassis 11. The timing belt 541 is extended and supported by an idle pulley 542. The timing belt 541 is combined with the carriage 50 via a damper made up of rubber to attenuate vibration of the carriage motor 54, thereby reducing image unevenness. To detect the position of the carriage 50, a code strip 561 with markings formed thereon at a pitch of 150 to 300 lpi is provided parallel to the timing belt 541. An encoder sensor that reads the markings is provided on a carriage substrate mounted on the carriage 50.

The carriage substrate also includes a contact for electric connection to the recording head. The carriage 50 also includes a flexible substrate 57 that transmits head signals from an electric substrate to the recording head.

To allow the recording head to be fixed to the carriage 50, the carriage 50 includes a pressing unit for pressing and fixing the recording head to an abutting portion of the carriage 50. The pressing unit is mounted on a head set lever 51. The pressing unit acts on the recording head when the head set lever 51 is set by being rotated around a rotating support point.

Eccentric cams are provided at the respective ends of the guide shaft 52. A driving force is transmitted to the eccentric cams via gear arrays by a main cam of the cleaning portion. Thus, the guide shaft 52 can be lifted and lowered. This also allows the carriage 50 to be lifted and lowered to form the optimum gap even for a sheet material P with a different thickness.

Moreover, an automatic registration sensor is attached to the carriage 50 to automatically correct a possible deviation of an impact position on the recording sheet P for the ink ejected from the recording head. The automatic registration sensor is a reflective optical sensor. The automatic registration sensor uses a light emitting element to emit light and receives reflected light from a predetermined recording pattern on the recording sheet P. Thus, an optimum registration value can be determined.

In the above-described construction, to allow an image to be formed on the sheet material P, the roller pair 36, 37 conveys the sheet material P to a row position (a position in the sheet material P conveying direction) where the image is to be formed. Simultaneously, the carriage motor 54 moves the carriage 50 to a column position (a position perpendicular to the sheet material P conveying direction) where the image is to be formed so that the recording head lies opposite an image forming position. Thereafter, as described above, in response to a signal from the electric substrate, the recording head ejects the ink to the sheet material P to form an image.

(D) Sheet Discharging Portion

The sheet discharging portion includes two sheet discharging rollers 40 and 41, a spur 42 which abuts against the sheet discharging rollers 40, 41 under a predetermined pressure and which can rotate in conjunction with the sheet discharging rollers 40 and 41, and a gear array that transmits driving from the conveying roller to the sheet discharging rollers 40 and 41.

The sheet discharging rollers 40 and 41 are attached to the platen 34. A plurality of rubber portions are provided on the metal shaft of the second sheet discharging roller 41, located on the downstream side in the sheet material P conveying direction. The driving force from the conveying roller 36 acts on a sheet discharging roller gear coupled directly to the second sheet discharging roller 41 via an idler gear, to drive the second sheet discharging roller 41. Furthermore, the first sheet discharging roller 40, provided on the upstream side of the second sheet discharging roller 41, is made of resin. The driving force to the first sheet discharging roller 40 is transmitted from the second sheet discharging roller 41 via another idler gear. Additionally, a code wheel with markings formed thereon at a pitch of 150 to 360 lpi is provided on the shaft of the first sheet discharging roller 40 to detect the conveyance amount of the first sheet discharging roller 40. An encoder sensor 403 that reads markings is attached to the chassis 11 at a position adjacent to the code wheel.

The spur 42 includes a thin stainless steel plate with a plurality of projecting shapes provided around the periphery thereof and integrated with a resin portion. The spur 42 is attached to a spur holder 43. A spur spring that is a bar-shaped coil spring allows the spur 42 to be attached to the spur holder 43 and to press the sheet discharging rollers 40 and 41. The spur 42 provides one of two possible functions. For one of the functions, the spur 42 is provided at a position corresponding to the rubber portions or elastic body portions of the sheet discharging rollers 40 and 41 to mainly generate a force required to convey the sheet material P. For the other function, the spur 42 is provided at a position where the rubber portions or elastic body portions of the sheet discharging rollers 40 and 41 are absent to mainly inhibit the sheet material P from floating when recording is performed.

In the above-described construction, the sheet material P with the image formed thereon by the carriage portion is sandwichingly held at the nip between the first sheet discharging roller 40 and the spur 42. The sheet material P is then conveyed and discharged to a sheet discharging tray 46. The sheet discharging tray 46 is adapted to be housed in a front cover 95. For use, the sheet discharging tray is withdrawn. The sheet discharging tray 46 is shaped so as to have a height increasing with decreasing distance to the tip thereof and the opposite ends thereof are higher than the middle thereof so as to improve stackability of discharged sheet material P and to prevent recorded faces from scraping.

(E) U Turn and Automatic Double-Side Portion

The sheet materials P are housed in a cassette provided in the front of the recording apparatus. To allow the sheet materials P to be separately fed, the cassette includes a pressure plate on which the sheet materials P are stacked and which is brought into abutting contact with a feeding roller 821. The feeding roller 821, a separating roller, a return lever and a pressurization and control unit are attached to a UT base of the main body; the feeding roller 821 feeds the sheet materials P, the separating roller separates a sheet material P from the remaining sheet materials P, the return lever returns the sheet materials P to the stack position, and the pressurization and control unit presses the sheet materials P against the pressure plate.

The cassette has a two-stage retracting construction. Which of the stages can be used depends on the size of the sheet materials P. When the sheet materials P have a small size or the cassette is not used, the cassette can be retracted and housed in the exterior portion of the main body.

The feeding roller 821 is shaped like a bar with a circular arc cross section. A piece of feeding roller rubber is provided close to a sheet reference to allow the sheet materials P to be fed. A driving force applied to the feeding roller 821 is transmitted, via drive transmitting gears and planet gears, by a U turn and automatic double-side motor provided in the U turn and automatic double-side portion.

A movable side guide is movably provided on the pressure plate to regulate the position where the sheet materials P are stacked. The pressure plate is rotatable around a rotating shaft combined with the cassette. The pressure plate is biased toward the feeding roller 821 by the pressurization and control unit, provided on a UT base and made up of a pressure plate spring. A separating sheet is provided in an area of the pressure plate located opposite the feeding roller 821; the separating sheet is made up of a material with a large friction coefficient to prevent possible double feeding of the sheet materials P. The pressure plate is configured to be able to abut against and separate from the feeding roller 821 via a pressure plate cam.

The UT base further includes a separating roller holder to which a separating roller separating a sheet material P from the remaining sheet materials P is attached. The separating roller holder is rotatable around a rotating shaft provided on a separating base. The separating roller holder is biased toward the feeding roller 821 by a separating roller spring. A clutch spring is attached to the separating roller. Thus, at least a predetermined amount of load allows rotation of the part of the separating roller holder to which the separating roller is attached. The separating roller is configured to be able to abut against and separate from the feeding roller 821 via a separating roller release shaft and a control cam. The positions of the pressure plate, the return lever, and the separating roller are detected by a UT sensor.

The return lever, which returns the sheet materials P to the stack position, is rotatably attached to the UT base. The return lever is biased in a releasing direction by a return lever spring. To return the sheet materials P, the return lever is rotated by the control cam.

In a normal standby state, the pressure plate is released by the pressure plate cam. The separating roller is released by the control cam. The return lever returns the sheet materials P and lies at a stack position such that the return lever closes a stack port so as to prevent the sheet materials P from moving toward the interior during stacking. In this state, to start feeding, the motor is driven. First, the separating roller comes into abutting contact with the feeding roller 821. Then, the return lever is released to bring the pressure plate into abutting contact with the feeding roller 821. In this state, feeding of the sheet materials P is started. The sheet materials P are restricted by a front-stage regulating portion provided on the UT base. Only a predetermined number of sheet materials P are fed to a nip portion formed of the feeding roller 821 and the separating roller. Only the highest sheet material P is separated from the other sheet materials and conveyed, by the nip portion.

When the separated and conveyed sheet material P reaches a first U turn intermediate roller 86 and a U turn pinch roller 861, described below, the pressure plate is released by the pressure plate cam. Furthermore, the separating roller is released by the control cam. The return lever is returned to the stack position by the control cam. At this time, the sheet material P having reached the nip portion, formed of the feeding roller 821 and the separating roller, can be returned to the stack position.

The first U turn intermediate roller 86 and a second U turn intermediate roller 87 are arranged on the downstream side of the feeding portion to convey the fed sheet material. Each of the rollers 86 and 87 includes a metal shaft made of core metal to which EPDM of rubber hardness 40 to 80° is attached at four to six positions. U turn pinch rollers 861 and 871 sandwichingly holding the sheet material P are attached to a spring shaft at positions corresponding to the rubber portions. The U turn pinch rollers 861 and 871 are biased toward the first U turn intermediate roller 86 and the second U turn intermediate roller 87. Furthermore, to form a conveying path, an inner guide 881 forming the inside and an outer guide 882 forming the outside are constructed.

The junction of the above-described feeding portion and a paper path is formed of a flapper to allow the respective paths to join smoothly. When the leading end of the recording sheet P is fed to the conveying roller 36 and pinch roller 37, described above, the leading end comes into abutting contact with the nip of the stopped roller pair. Then, a registering operation is performed.

The sheet material P with recording performed thereon passes between the conveying roller 36 and the pinch roller 37. During automatic double-side recording, the trailing end of the sheet material P is sandwiched between the conveying roller 36 and the pinch roller 37 again and then conveyed.

The fed-back sheet material P is sandwiched between a double-side roller 891 and a pinch roller and conveyed. The sheet material P is then guided and conveyed by a guide. The double-side paper conveying path is configured to join the above-described U turn conveyance paper path at a position where the predetermined amount of conveyance is exceeded. Thus, the construction and effects of the succeeding part of the paper path are the same as those described above.

(F) Cleaning Portion

The cleaning portion includes a pump 60 that cleans the recording head, a cap 61 that inhibits the recording head from being dried, and a blade 62 that cleans a part of the face of recording head located around the periphery of the nozzle.

(G) Exterior Portion

The above-described units are incorporated into the chassis 11 to make up the mechanical portion of the recording apparatus. An exterior is attached so as to cover the circumference thereof. The exterior mainly includes a lower case 99, an upper case 98, an access cover 97, a connector cover, a front cover 95, and a side cover 93.

The front cover 95 is configured such that the sheet discharging tray 46 can be housed in the front cover 95 and such that the front cover 95 closes a sheet discharging port while the apparatus is not in use. Whether the front cover 95 is open or closed can be detected by a sensor (not illustrated in the drawings).

The access cover 97 is attached to the upper case 98 so as to be pivotally movable. An opening is formed in a part of the top surface of the upper case 98. At the position of the opening, the ink tank and the recording head can be replaced with new ones. Moreover, a door switch lever, an LED guide 982, and a key switch 983 are provided on the upper case 98; the door switch lever allows detection of whether the access cover 97 is open or closed, the LED guide 982 transmits and displays light from LEDs, and the key switch 983 acts on switches on the substrates in the apparatus. The feeding tray 26 is also pivotally movably attached to the upper case 98. While the feeding portion is not in use, the feeding tray 26 can be housed as a cover for the feeding portion.

(Linking Mechanism)

Now, a linking mechanism allowing the PE sensor lever 321 to advance into or retract from the disk medium conveying path in conjunction with the posture of a disk medium supply guide will be described in detail with reference to FIGS. 5 to 7D.

Figure 5:
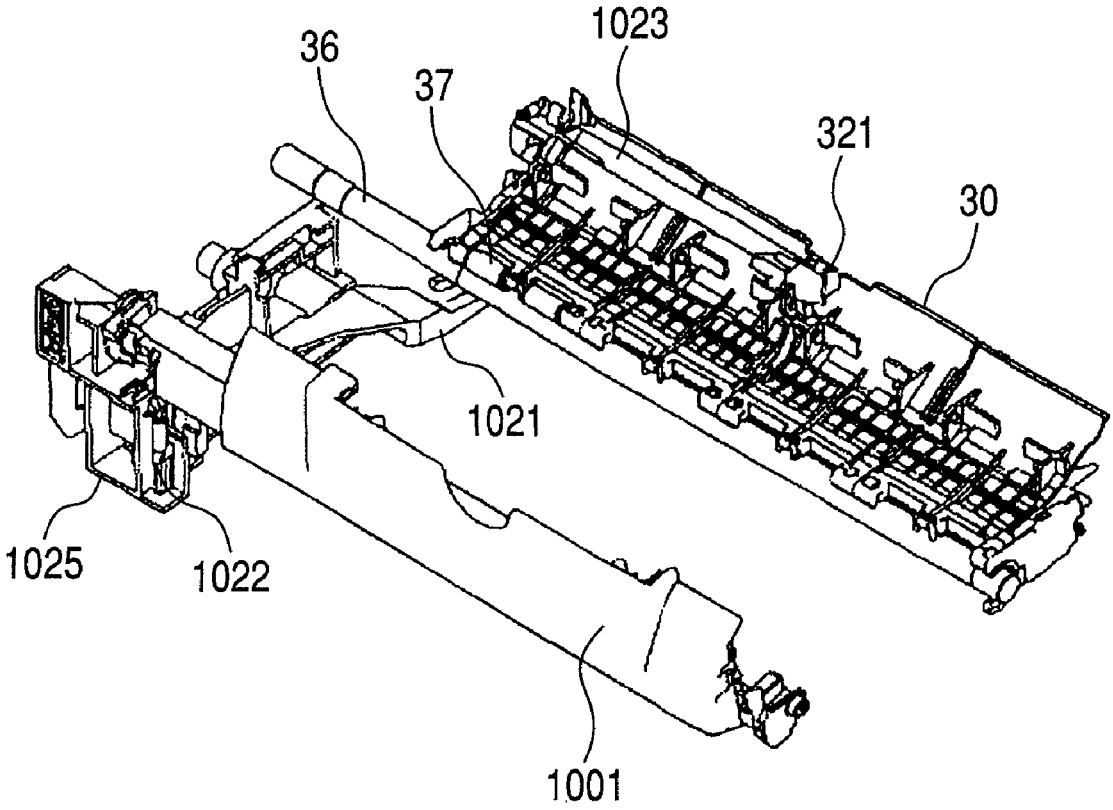
FIG. 5 is a perspective view illustrating a linking mechanism that moves the PE sensor lever.

FIG. 5 is a perspective view showing the linking mechanism. A tray can be stacked on a tray guide 1001. The tray guide 1001 can take a stack position in which the tray is stacked on the tray guide 1001 (open position; second position) and a housing position (closed position; first position). The tray guide 1001 is configured so as to be able to guide a tray 1003 supporting disk-shaped recording media (disk media). The tray guide 1001 is also configured such sheet-like recording media (sheet materials) can be stacked and guided on the tray guide 1001.

Figure 6A:
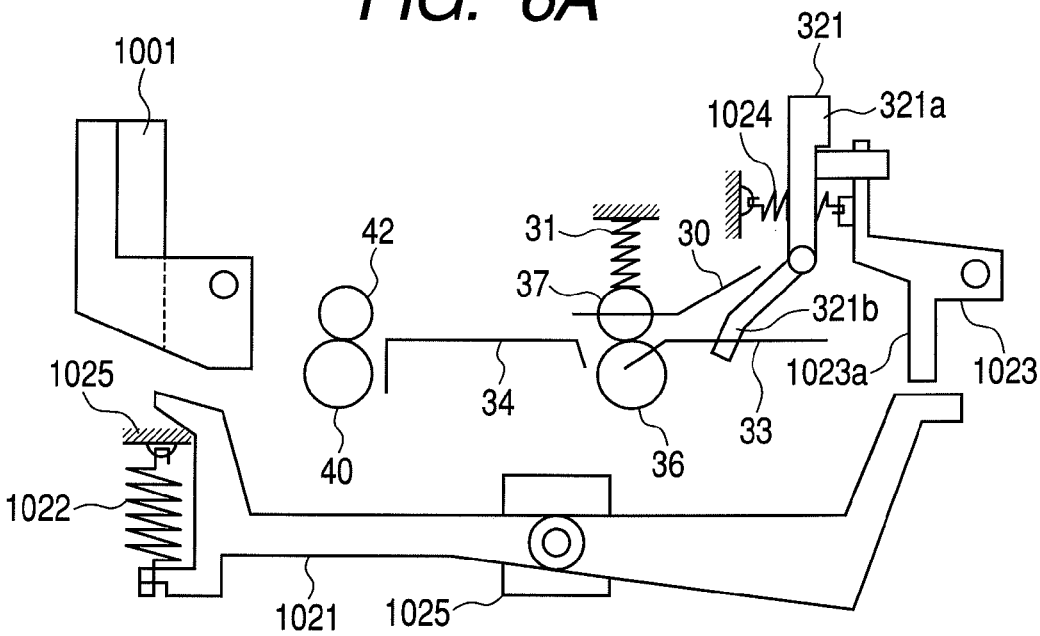
FIGS. 6A and 6B are sectional views schematically illustrating the linking mechanism illustrated in FIG. 5.
Figure 6B:
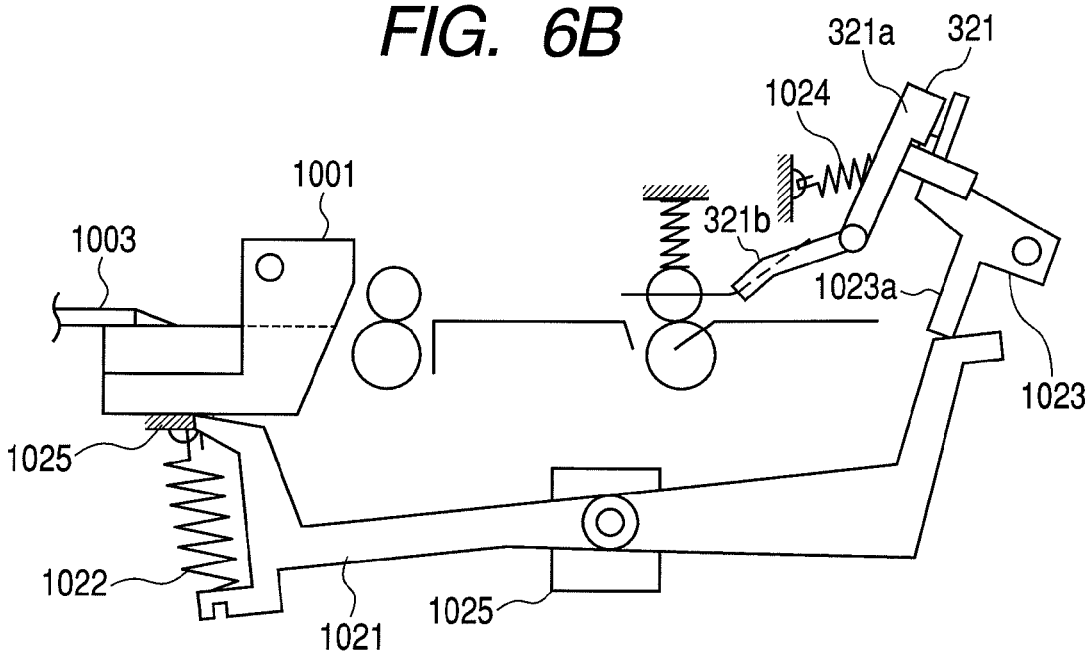

FIGS. 6A and 6B are sectional views schematically showing the linking mechanism illustrated in FIG. 5. FIG. 6A illustrates that the tray guide is located in the closed position (first position). FIG. 6B illustrates that the tray guide is located in the open position (second position).

FIG. 6A illustrates that a first link member 1021 as a transmitting unit is rotatably supported by a link base 1025. The first link member 1021 is biased by a spring 1022 so that one end of the first link member 1021 is positioned in proximity to the tray guide 1001. A second link member 1023 as a moving unit is supported so as to be rotatable around a rotating shaft. The second link member 1023 is biased by a spring 1024 so that an operating end 1023*a* of the second link member 1023 is positioned in proximity to the other end of the first link member 1021. The operating end 1023*a* of the second link member 1023 is pushed by the other end of the first link member 1021 to pivotally move the second link member 1023 around the rotating shaft. The second link member 1023 then engages with the PE sensor lever 321. Then, the second link member 1023 further moves pivotally in the same direction. The PE sensor lever 321 then moves together with the second link member 1023. The abutting portion 321*b* of the PE sensor lever 321 is then retracted from the recording medium conveying path. As illustrated in FIG. 6A, a pinch roller spring 31 biases the pinch roller 37 toward the conveying roller 36. In FIG. 6A, the pinch roller spring 31 is a compression spring. However, the pinch roller spring 31 may be a torsion coil spring or the like. When the user moves the tray guide 1001 to the stack position, the movement is transmitted to the first link member through motion of the first link member. That is, the bottom of the tray guide 1001 pushes the one end of the first link member 1021. The first link member 1021 moves pivotally to bring the other end of the first link member 1021 into abutting contact with the second link member 1023 to pivotally move the second link member 1023.

FIG. 6B illustrates that the user operates the tray guide 1001 so that the tray guide 1001 moves pivotally from the housing position to the stack position. In this case, the recording apparatus enables the tray 1003 to be inserted into the recording medium conveying path. In this state, the tray guide 1001 comes into abutting contact with the one end of the first link member 1021, which is thus rotated around a rotating shaft of the link base 1025. Then, the other end of the first link member 1021 comes into abutting contact with the operating end 1023*a* of the second link member 1023, which is thus pivotally moved around the rotating shaft. Moreover, the PE sensor lever 321 moves in conjunction with the pivotal movement of the second link member 1023 to retract the abutting portion 321*b* of the PE sensor lever 321 from the recording medium conveying path.

FIGS. 7A to 7D are schematic diagrams showing the relationship between the posture of the tray guide and the posture of the PE sensor lever.

Figure 7A:
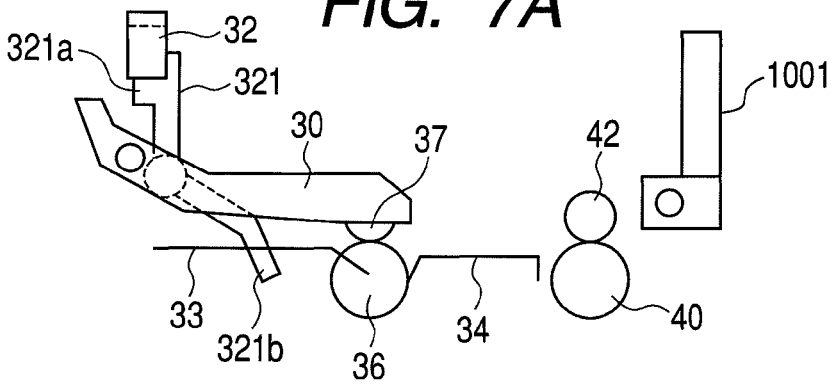
FIGS. 7A, 7B, 7C and 7D are schematic diagrams illustrating the relationship between the posture of a disk tray guide and the posture of the PE sensor lever.

FIG. 7A illustrates a standby position for a normal recording operation of performing recording on the sheet material P such as paper or a plastic sheet. In this position, the abutting portion 321*b* of the PE sensor lever 321 enters the recording medium conveying path formed of the pinch roller holder 30 and the paper guide 33. The tray guide 1001 is located in the closed position (first position) corresponding to the housing position. In this position, the tray guide 1001 avoids interfering with the sheet material P discharged during the normal recording operation.

Figure 7B:
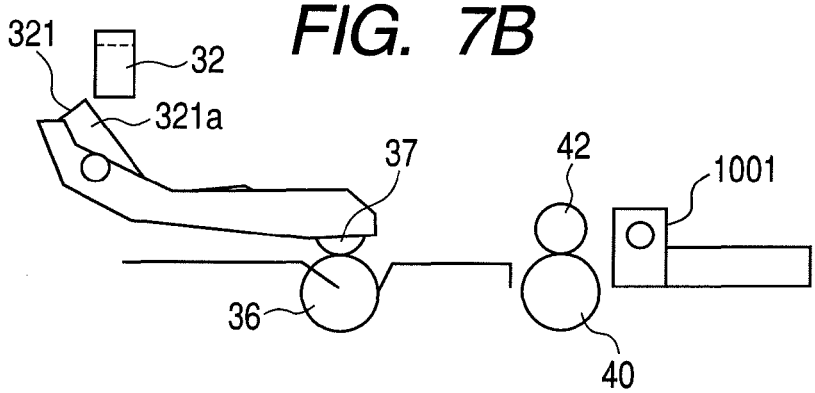

FIG. 7B illustrates a state following the one illustrated in FIG. 7A and in which the tray guide 1001 is moved to the open position corresponding to the stack position, in which the tray 1003 is stacked on the tray guide 1001. In this case, the first and second link member (not illustrated in FIGS. 7A to 7D), described with reference to FIGS. 6A and 6B, allow the abutting portion 321*b* of the PE sensor lever 321 to be retracted from the recording medium conveying path.

Figure 7C:
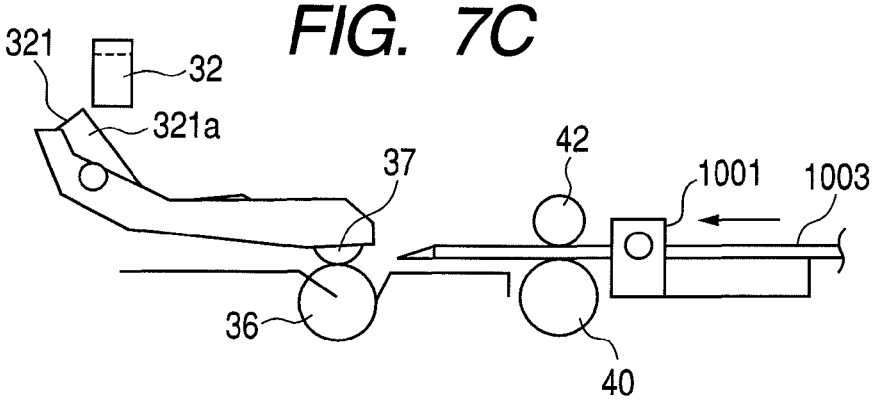

FIG. 7C illustrates a state following the one illustrated in FIG. 7B and in which the tray 1003 with the disk medium installed thereon is inserted from the sheet discharging side (the front side of the main body) of the recording apparatus into the recording medium conveying path via the tray guide 1001. In the state illustrated in FIG. 7C, the tray 1003 passes through the nip portion between the sheet discharging roller 40 and the spur 42.

Figure 7D:
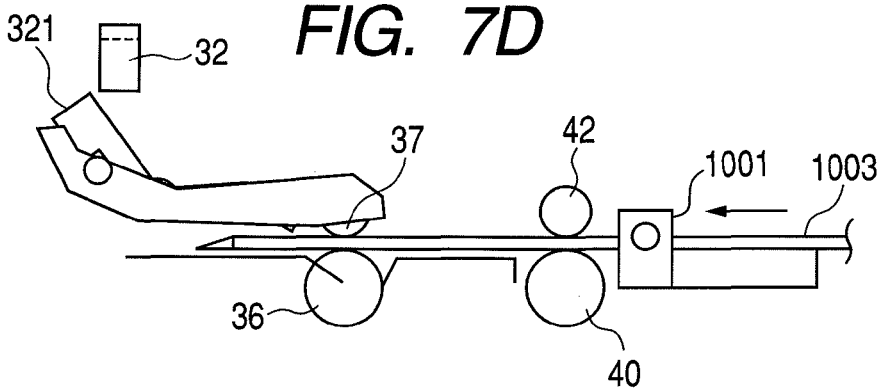
Figure 8:
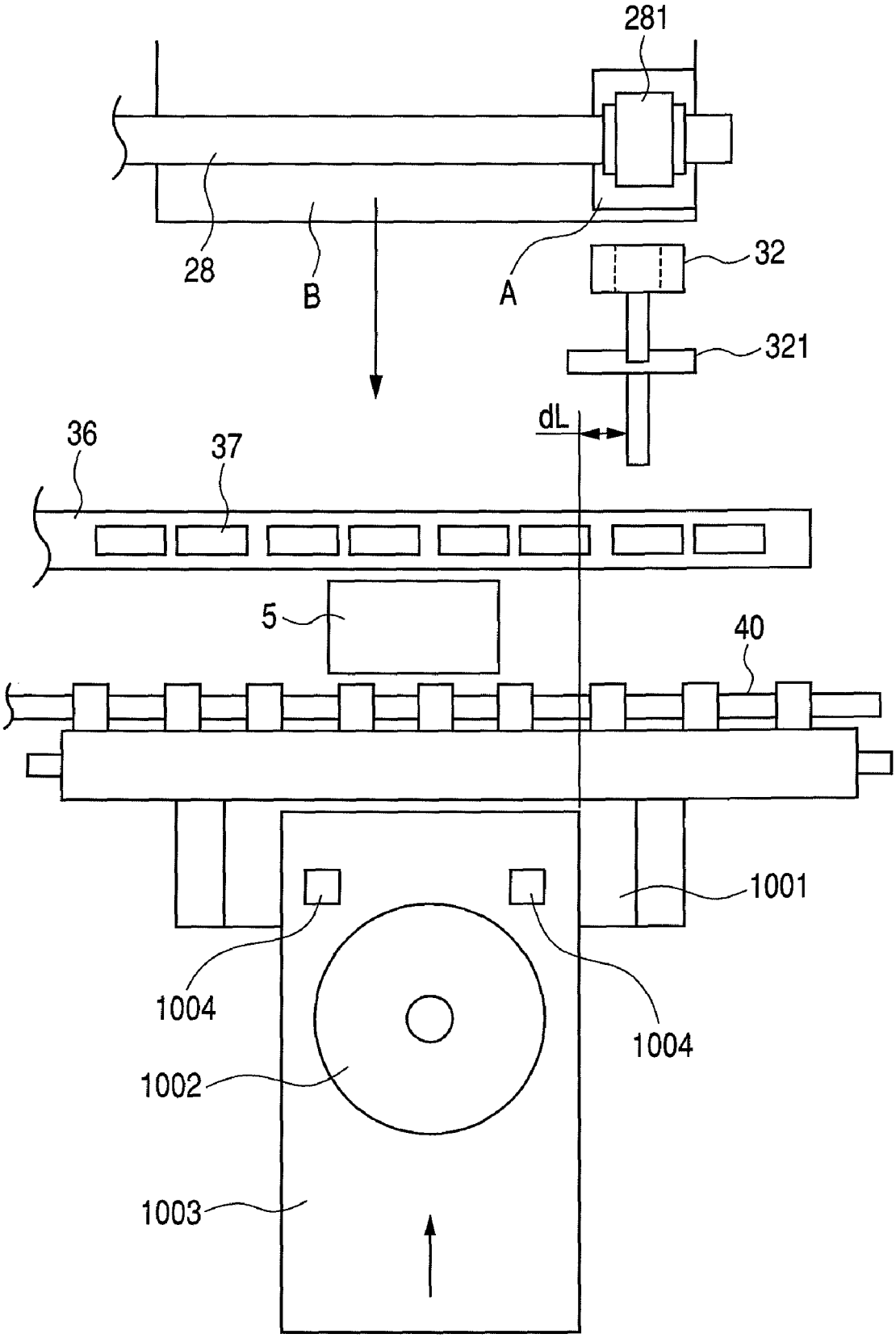
FIG. 8 is a diagram illustrating the arrangement relationship between a PE sensor lever and a conveying path for a disk medium tray in a conventional recording apparatus.
Figure 9:
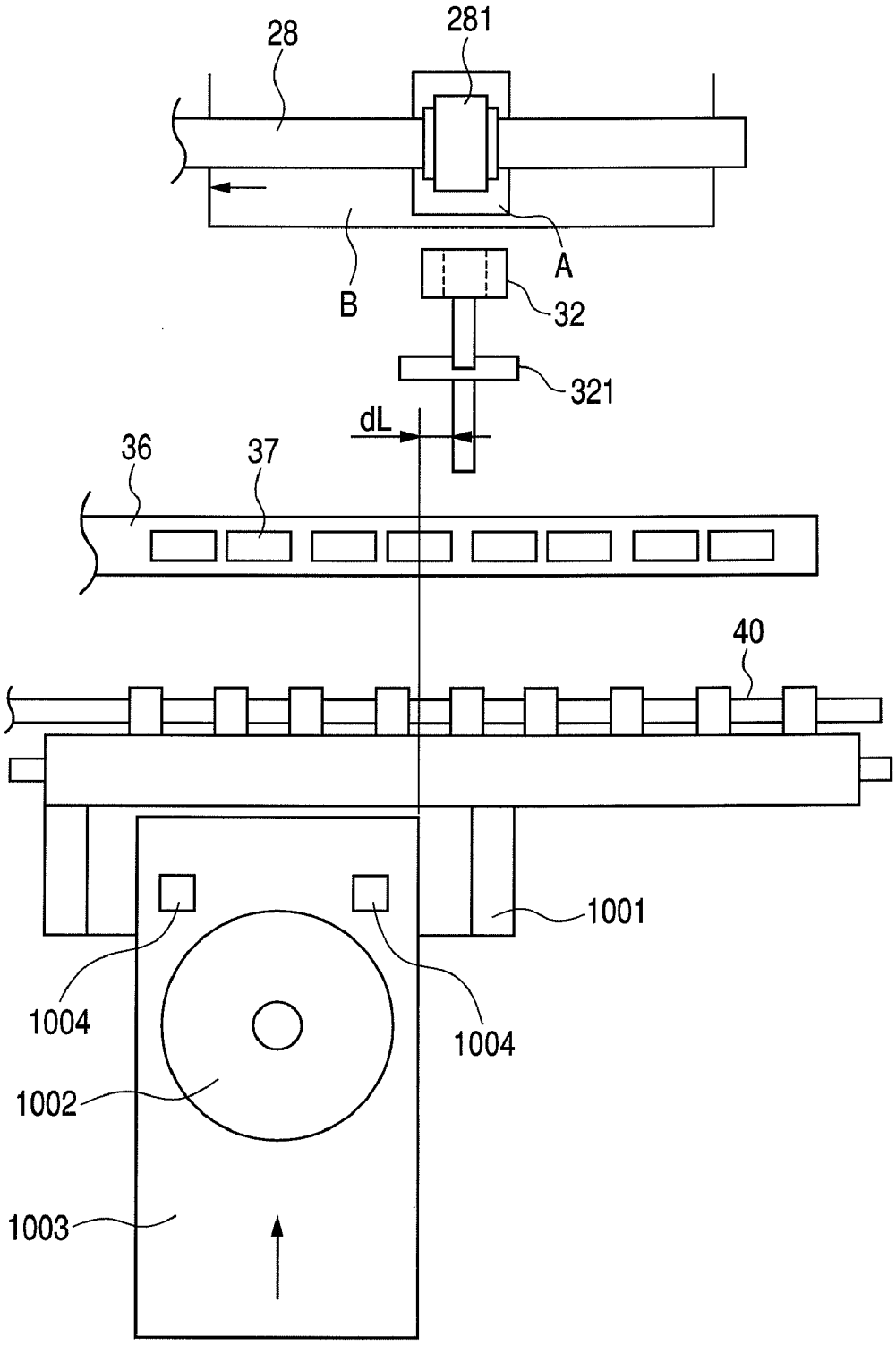
FIG. 9 is a diagram illustrating the arrangement relationship between the PE sensor lever and the conveying path for the disk medium tray in the conventional recording apparatus.
Figure 10:
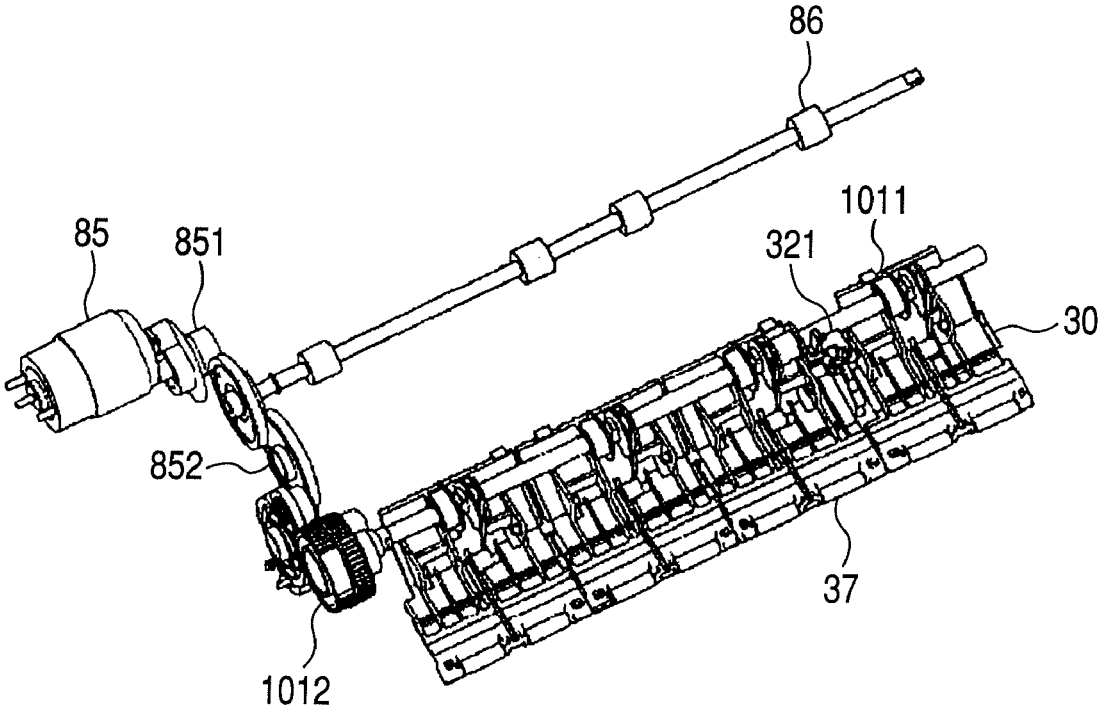
FIG. 10 is a perspective view illustrating a construction for a conventional recording apparatus which retracts a PE sensor lever from a recording medium conveying path.
Figure 11A:
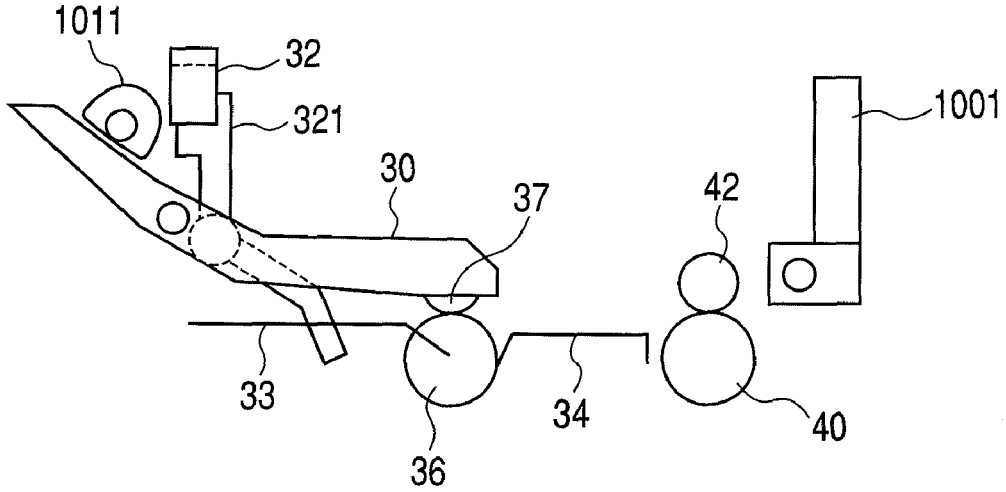
FIGS. 11A, 11B and 11C are schematic sectional views illustrating a retracting operation in the conventional construction illustrated in FIG. 10.
Figure 11B:
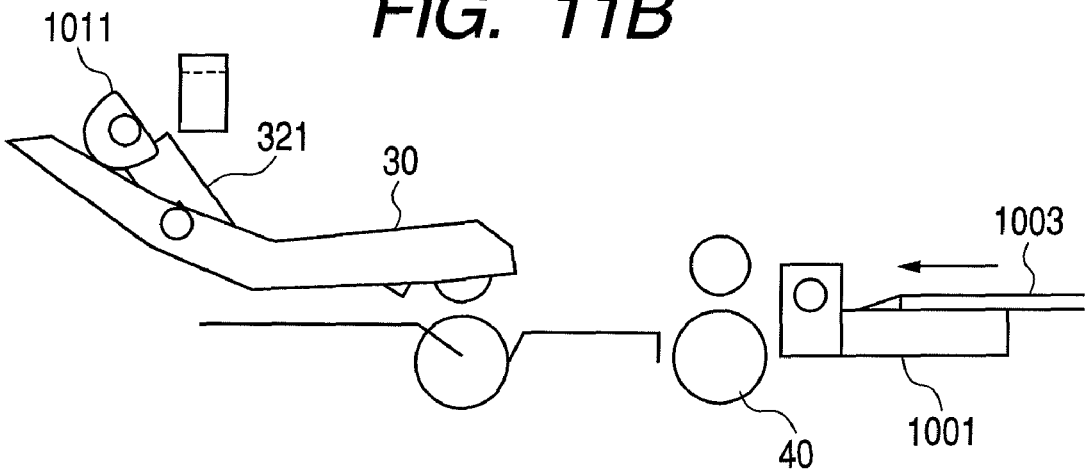
Figure 11C:
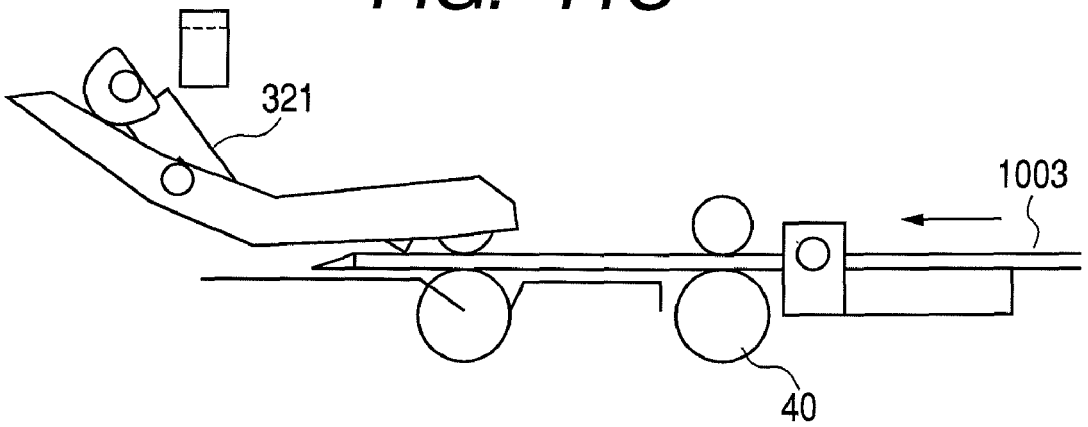
Figure 12A:
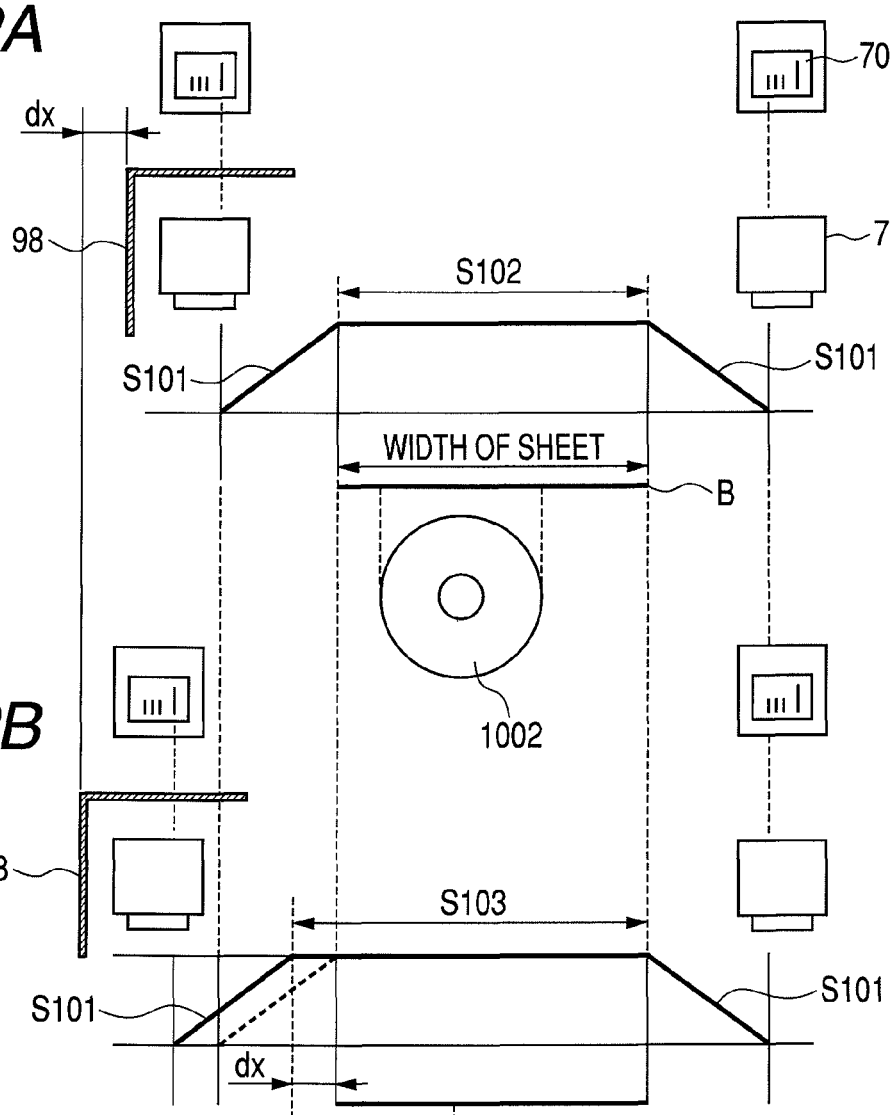
FIG. 12 is a diagram illustrating a sheet material and a disk medium conveying path in the conventional recording apparatus.
Figure 12B:
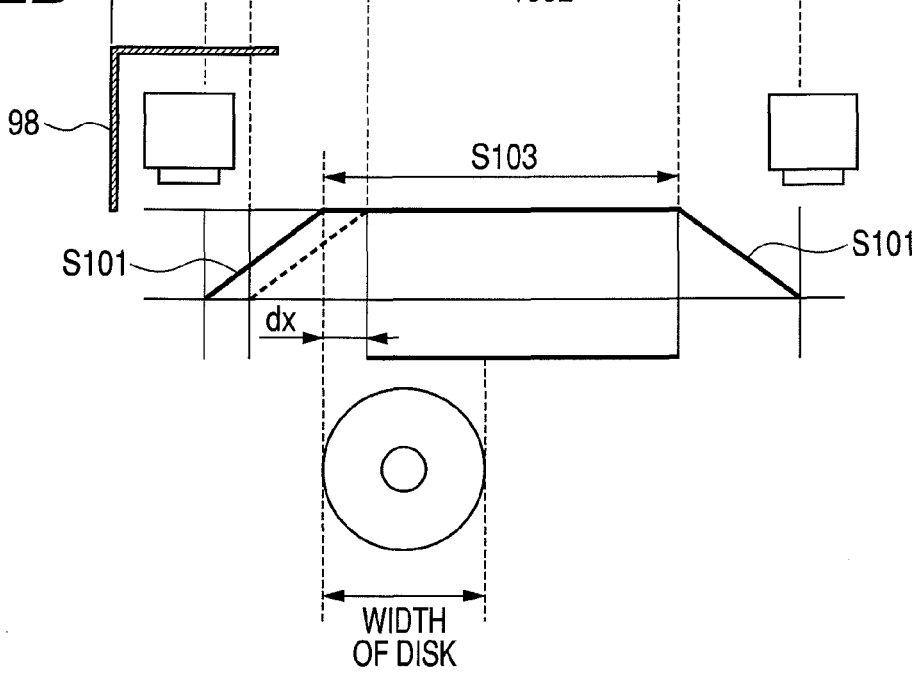
Figure 13:
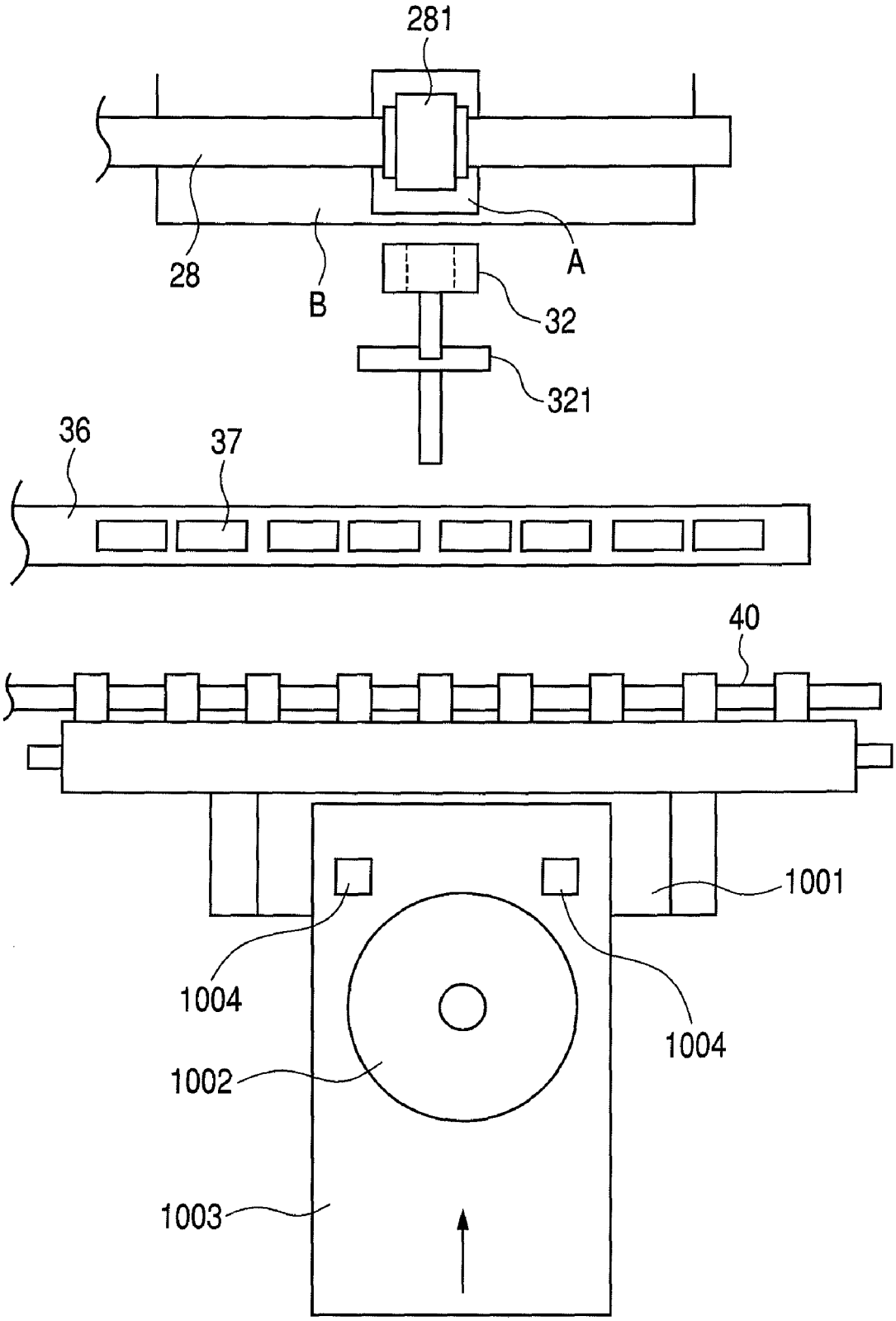
FIG. 13 is a diagram illustrating a construction for the conventional recording apparatus in which a PE sensor lever is located in a recording medium conveying path.

FIG. 7D illustrates a state following the one illustrated in FIG. 7C and in which the tray 1003 is inserted further toward the interior of the recording apparatus. In the state illustrated in FIG. 7D, the tip of the tray 1003 passes through the nip portion between the conveying roller 36 and the pinch roller 37. At this time, the abutting portion 321*b* of the PE sensor lever 321 is retracted from the conveying path, thus preventing the tray 1003 from contacting the PE sensor lever 321. The tray 1003 can thus be inserted far into the recording apparatus. Then, by reading the position of the reflector on the tray, the position of the disk medium can be determined. As a result, the recording head can perform recording on the disk medium.

As described above, according to the construction of the exemplary embodiment, the user uses the tray guide 1001, provided on the front surface of the recording apparatus, to operate the linking mechanism, which connects the tray guide 1001 and the PE sensor lever 321 together. Then, with the tray guide 1001 located so as to enable the tray 1003 to be set in the recording apparatus, the abutting portion 321*b* of the PE sensor lever 321 can be retracted from the recording medium conveying path. Furthermore, with the tray guide 1001 located in the housing position, the abutting portion 321*b* of the PE sensor lever 321 can enter the recording medium conveying path to maintain the posture in which the PE sensor lever 321 can detect the end of the sheet material P.

The operation of retracting and advancing the abutting portion 321*b* of the PE sensor lever 321 from and into the conveying path are mechanically performed in conjunction with the user's operation of the tray guide 1001. Thus, even with the recording apparatus powered off, provided that the tray guide 1001 is located in the open position, the PE sensor lever 321 is prevented from being destroyed when the tray 1003 is inserted into the recording apparatus.

Furthermore, the linking mechanism according to the exemplary embodiment enables the tray 1003 to be conveyed within the area corresponding to the maximum width of the sheet material P while allowing the abutting portion 321*b* of the PE sensor lever 321 to be placed in the sheet material P conveying path. Thus, the exemplary embodiment can provide a recording apparatus that enables recording on the disk medium without the need to increase the size of the recording apparatus.

In the exemplary embodiment, the transmitting unit is the first link member 1021. However, the transmitting unit may be a combination of a plurality of link members. Alternatively, instead of the link member, a gear array, a belt, a wire, or a combination thereof may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-122343, filed May 8, 2008, which is hereby incorporated by reference herein in its entirety.

What is claimed is:

1. A conveying apparatus comprising:

a lever swinging in contact with a recording medium conveyed along a conveying path in a conveying direction;

a sensor detecting the swinging of the lever;

a moving unit for moving the lever from a position where the lever is allowed to contact the recording medium in the conveying path to a position where the lever is retracted from the conveying path;

a guide unit being movable between a first position and a second position, the guide unit guiding a recording medium conveyed in a direction opposite to the conveying direction to the conveying path when the guide unit is located in the second position; and a transmitting unit for transmitting the movement of the guide unit to the moving unit through motion of at least one member to link the movement of the guide unit from the first position to the second position with the movement of the lever to the position where the lever is retracted from the conveying path, the movement of the lever being performed by the moving unit.

2. The conveying apparatus according to claim 1, wherein the transmitting unit comprises a linking mechanism including a plurality of link members.

3. The conveying apparatus according to claim 1, wherein the sensor includes a light receiving portion and a light emitting portion, and a shielding portion provided in the lever prevents light from the light emitting portion from reaching the light receiving portion to detect the swinging of the lever.

4. The conveying apparatus according to claim 3, wherein the lever includes a swinging center above the conveying path so as to swing in contact with the recording medium conveyed in the conveying direction, and the lever is inclined downward to a downstream side in the conveying direction.

5. The conveying apparatus according to claim 1, wherein the guide unit is allowed to guide a tray supporting the recording medium with a disk shape.

6. The conveying apparatus according to claim 1, wherein the guide unit is allowed to guide the recording medium with a sheet shape.

7. A recording apparatus comprising the conveying apparatus according to claim 1 and a recording unit for recording an image on a recording medium conveyed by the conveying apparatus.

* * * * *